US005323974A

United States Patent [19]

Watajima

[11] Patent Number: 5,323,974

[45] Date of Patent: Jun. 28, 1994

[54] VERTICAL SHAFT IMPACT CRUSHER

[75] Inventor: Teruji Watajima, Takeo, Japan

[73] Assignee: Nakayama Iron Works, Ltd., Takeo, Japan

[21] Appl. No.: 990,200

[22] Filed: Dec. 14, 1992

[30] Foreign Application Priority Data

Mar. 27, 1992 [JP] Japan ..... 4-102305
Apr. 24, 1992 [JP] Japan ..... 4-129815

[51] Int. Cl.[5] ..... B02C 13/09; B02C 19/00

[52] U.S. Cl. ..... 241/275; 241/285.2; 241/286; 241/300

[58] Field of Search ..... 241/275, 285.2, 286, 241/299, 300

[56] References Cited

U.S. PATENT DOCUMENTS

| | | | |
|---|---|---|---|
| 3,168,991 | 2/1965 | Herman | 241/275 |
| 3,955,767 | 5/1976 | Hise | 241/275 |
| 4,090,673 | 5/1978 | Ackers et al. | 241/275 |
| 4,513,919 | 4/1985 | Terrenzio | 241/275 |
| 4,575,014 | 3/1986 | Szalanski et al. | 241/275 |
| 4,699,326 | 10/1987 | Warren | 241/275 |
| 4,717,084 | 1/1988 | Vendelin et al. | 241/207 |

*Primary Examiner*—Mark Rosenbaum
*Assistant Examiner*—John M. Husar
*Attorney, Agent, or Firm*—Armstrong, Westerman, Hattori, McLeland & Naughton

[57] ABSTRACT

A vertical shaft impact crusher including a housing, a vertical rotating shaft (11) rotatably provided in the housing and rotated at a high speed, a rotor (10) provided on the upper end of the vertical rotating shaft (11) to discharge centrifugally an object of crushing, which is cast into the housing, to the outer periphery thereof, and an anvil support frame (60) disposed in the housing to surround the outer periphery of the rotor (10) and provided with anvils (18) for collision with the object of crushing discharged from the rotor (10). The anvil support frame (60) is movable up and down in a direction parallel to the central axis of the vertical rotating shaft (11). The vertical shaft impact crusher further includes support means (71) disposed in the housing for supporting the lower end of the anvil support frame (60), vertically moving means (72) disposed in the housing for vertically moving the anvil support frame (60) in the direction of the central axis, and heightwise position adjusting means (73) disposed on the support means (71) for adjusting the heightwise position of the anvils (18) when the anvil support frame (60) is moved up by the vertically moving means (72), thereby reducing the frequency of replacement of the anvils, and thus facilitating maintenance.

27 Claims, 13 Drawing Sheets

VERTICAL SHAFT IMPACT CRUSHER

BACKGROUND OF THE INVENTION

1. Field of the Invention

The present invention relates to a vertical shaft impact crusher. More particularly, the present invention relates to a vertical shaft impact crusher for crushing bulk materials, for example, natural rock, into particles of predetermined diameter.

2. Description of the Prior Art

Bulk materials, e.g., natural rock, are crushed in accordance with various uses, for example, aggregate for concrete, paving stone, subgrade material, etc. One type of crusher used for such crushing process is known as vertical shaft impact crusher.

In the vertical shaft impact crusher, a rotor having a plurality of blades on the upper side thereof is rotated at high speed, whereby raw stone cast in the crusher is accelerated by the blades and centrifugally discharged so as to collide with anvils which are disposed in a ring shape around the rotor, thereby crushing the raw stone. During such crushing process, large impact force is applied to the blades and the anvils, so that these members are likely to become worn.

For this reason, manganese steel or other wear-resistant material is used for the blades and the anvils. However, even if such a material is used, wear of these members cannot be avoided, and these members must be frequently replaced with new ones. Various propositions have heretofore been made to reduce the frequency of replacement of these members.

As a proposition made for the purpose of reducing the frequency of replacement of anvils, for example, a vertical shaft impact crusher, which is disclosed in Japanese Patent Application Public Disclosure (KOKAI) No. 63-88054 (1988), is known. In this crusher, a stepped support block having a plurality of steps with different heights is provided on the inner wall of a crushing tank, and a hoop that supports anvils is supported on the stepped support block.

With the above-described crusher, the heightwise position of the anvils can be changed by shifting the position where the hoop is attached to the stepped support block. Accordingly, the range of collision between raw stone and the anvils enlarges in the heightwise direction, so that non-uniform wear of the anvils can be prevented to a certain extent. Therefore, the frequency of replacement of the anvils decreases.

However, the conventional vertical shaft impact crusher necessitates lifting the hoop from the outside when the heightwise position of the anvils is changed. In addition, the hoop must be rotated through a very small angle in order to position a vertical leg, which is provided on the lower side of the hoop, to the desired step of the stepped support block. Accordingly, the above-described crusher suffers from the disadvantage that the adjustment of the heightwise position of the anvils requires a troublesome operation and a great deal of time.

As a proposition made for the purpose of reducing the frequency of replacement of blades, for example, a vertical shaft impact crusher, which is disclosed in Japanese Patent Application Public Disclosure (KOKAI) No. 62-193657 (1987), is known. In this crusher, a pair of blades, which define a discharge passage, are provided on the upper side of a rotor in symmetry with respect to the radial direction, and the rotor is rotated forwardly and then backwardly, with a view to avoiding non-uniform wear of the blades. With this crusher, the range of collision between raw stone and the blades is enlarged by reversing the direction of rotation of the rotor, so that non-uniform wear can be prevented to a certain extent. Therefore, the frequency of replacement of the blades also decreases.

Raw stone is cast onto the rotor from above it, as described above. Accordingly, even in such an impact crusher, wear unavoidably concentrates on only the lower part of each blade. In addition, blades that are used in this type of crusher are heavy in weight. Therefore, maintenance is not easy.

Further, U.S. Pat. No. 4,090,673 discloses a vertical shaft impact crusher having an improved impeller table liner. However, the specification of this prior art does not explain improvement in wear of the blades and the anvils in detail.

SUMMARY OF THE INVENTION

The present invention has been accomplished on the basis of the above-described conventional technical background, and aims at attaining the following objects.

It is an object of the present invention to provide a vertical shaft impact crusher in which anvils are each allowed to wear over the entire area thereof in the heightwise direction, thereby permitting a reduction in the frequency of replacement of the anvils.

It is another object of the present invention to provide a vertical shaft impact crusher in which blades are each allowed to wear over the entire area thereof, thereby permitting a reduction in the frequency of replacement of the blades.

It is still another object of the present invention to provide a vertical shaft impact crusher in which the heightwise position of anvils can be readily adjusted by a simple operation, so that maintenance is facilitated.

It is a further object of the present invention to provide a vertical shaft impact crusher in which blades can be readily attached and removed by a simple operation, so that maintenance is facilitated.

To attain these objects, the present invention provides a vertical shaft impact crusher including a housing, a vertical rotating shaft (11) rotatably provided in the housing and rotated at a high speed, a rotor (10) provided on the upper end of the vertical rotating shaft (11) to discharge centrifugally an object of crushing, which is cast into the housing, to the outer periphery thereof, and an anvil support frame (60) disposed in the housing to surround the outer periphery of the rotor (10) and provided with anvils (18) for collision with the object of crushing discharged from the rotor (10). The anvil support frame (60) is movable up and down in a direction parallel to the central axis of the vertical rotating shaft (11). The vertical shaft impact crusher further includes support means (71) disposed in the housing for supporting the lower end of the anvil support frame (60); vertically moving means (72) disposed in the housing for vertically moving the anvil support frame (60) in a direction parallel to the central axis of the vertical rotating shaft (11); and adjusting means (73) disposed on the support means (71) for adjusting the heightwise position of the anvils (18) when the anvil support frame (60) is moved up by the vertically moving means (72).

In addition, the present invention provides a vertical shaft impact crusher including a housing, a vertical rotating shaft (11) rotatably provided in the housing and rotated at a high speed, and a rotor (10) provided on the upper end of the vertical rotating shaft (11) to discharge centrifugally an object of crushing, which is cast into the housing, toward an impact surface (18) disposed at the outer periphery thereof. The vertical shaft impact crusher further includes means for driving the vertical rotating shaft (11) to rotate forwardly and backwardly; a rotor body (21) secured to the vertical rotating shaft (11); a substantially disk-shaped distributing plate (22) disposed in the center of the upper side of the rotor body (21); a plurality of supports (23) provided on the upper side of the rotor body (21) at a regular angular spacing around the outer periphery of the distributing plate (22); blades (24) disposed on the supports (23), respectively, so as to cover at least two side surfaces of each support (23), which extend substantially radially of the rotor body (21); means (48) or (98) for detachably retaining the blades (24) on the supports (23); a discharge passage (44) formed in between each pair of adjacent blades (24); and a discharge passage liner (25) disposed on the discharge passage (44).

Normally, when the use of the crusher is to be started, a raised position of the anvils is set by adjusting the heightwise position adjusting means, and the anvils are placed in the raised position. When the anvils are in the raised position, the lower portions thereof wear. When the lower portions of the anvils have become worn, with the support frame maintained in the raised position by the action of the vertically moving means, the set height is properly lowered by adjusting the heightwise position adjusting means, and the anvils are lowered to the set height by the action of the vertically moving means. Consequently, the impact region of each anvil shifts to the upper portion thereof. In this way, as the service time of the crusher elapses, the anvils are gradually lowered, thereby subjecting each anvil to wear over the entire area thereof in the heightwise direction.

When the rotor is rotated forwardly, the lower-half portion of one blade plate of the blade wears. When the lower-half portion of this blade plate has become worn, the rotor is rotated backwardly. Consequently, the lower-half portion of the other blade plate wears. When the lower-half portions of the two blade plates have become worn by the forward and backward rotation of the rotor, the blade is removed from the support, and turned upside down, and then remounted onto the support. Then, the rotor is rotated forwardly and then backwardly, thereby subjecting the upper-half portions (remaining half portions) of the two blade plates to wear.

DETAILED DESCRIPTION OF THE EMBODIMENTS

Figure 1:
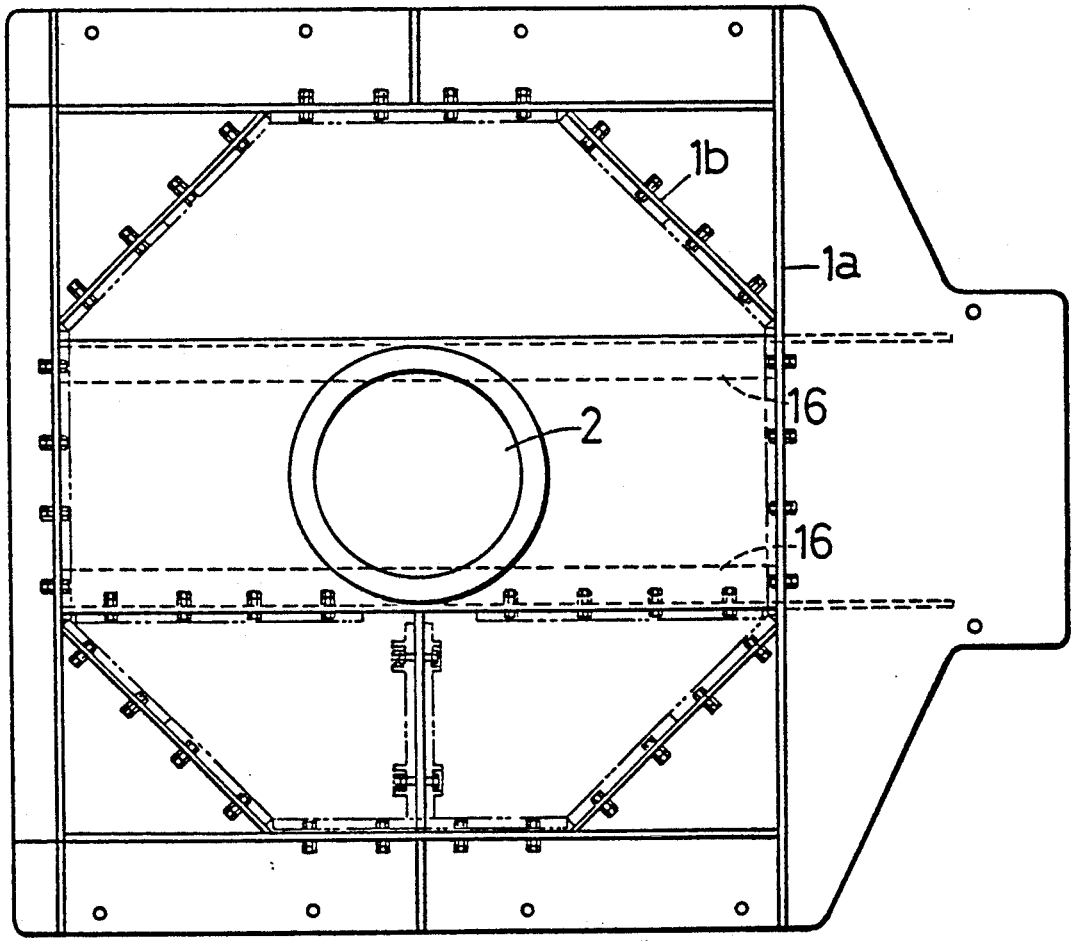
FIG. 1 is a plan view of the vertical shaft impact crusher according to the present invention.

One embodiment of the present invention will be described below with reference to the accompanying drawings.

General Structure of Vertical Shaft Impact Crusher

FIGS. 1 to 4 show the general structure of the vertical shaft impact crusher according to the present invention. The housing of the vertical shaft impact crusher comprises a lower housing 1*a*, and an upper housing 1*b* that is detachably secured to the top of the lower housing 1*a* through fastening members 9 that are pivotable about respective pins 9*a*. The upper housing 1*b* is movable so as to be opened and closed with respect to the lower housing 1*a* by the action of a lever 5, which is activated to move up and down by a hydraulic cylinder 4 and swiveled on a swivel shaft 3.

The upper housing 1*b* has a feed opening 2 for raw stone, and guide chutes 7 and 8 are disposed in two stages below the feed opening 2. The lower guide chute 8 is provided at the lower end of a plurality of vertical ribs 8*a* which are disposed in an annular shape as a whole. In addition, a rotor 10 is disposed below the guide chute 8.

The rotor 10 is secured to the upper end of a vertical rotating shaft 11. The shaft 11 is rotatably accommodated in a shaft housing 15 through bearings 13 and 14. The shaft housing 15 is supported by the lower housing la through brackets 16. A pulley 17 is provided on the lower end of the vertical rotating shaft 11, so that the shaft 11 is rotated back and forth by a reversible motor (not shown) through a belt (not shown).

Structure of Vertically Moving Anvils

Figure 2:
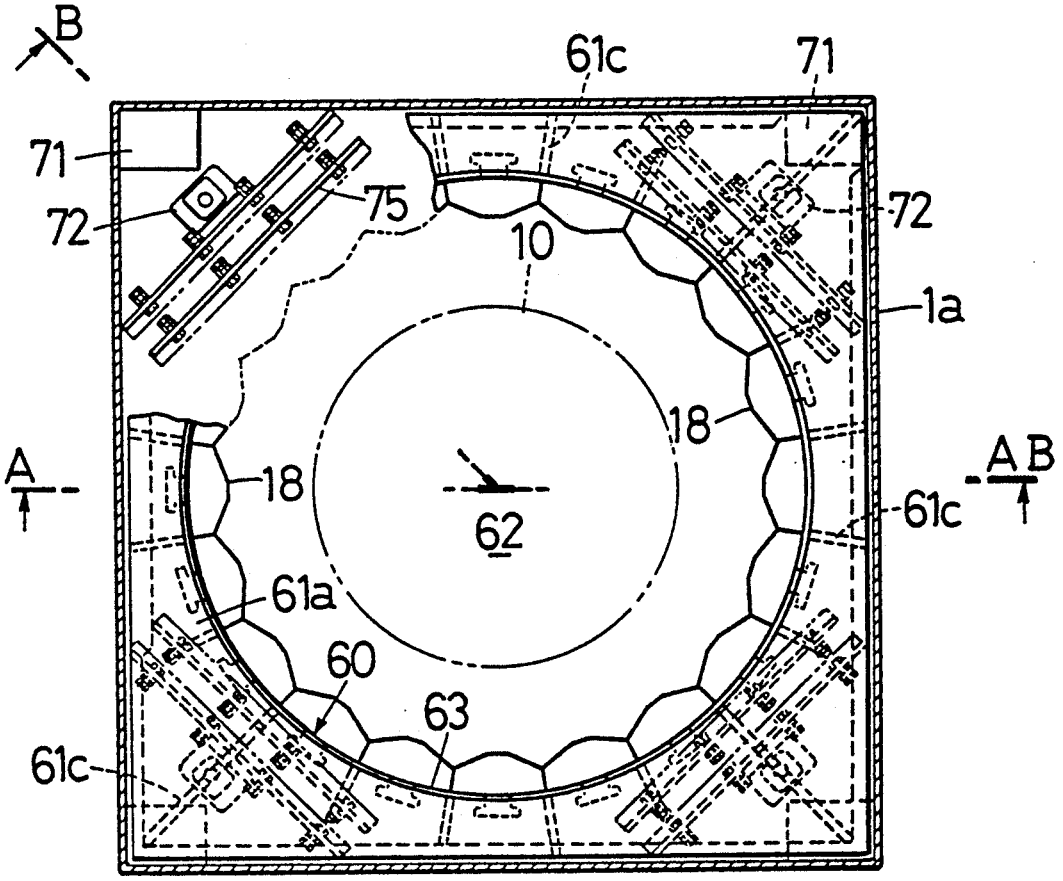
FIG. 2 is a plan view showing the inside of a housing of the vertical shaft impact crusher according to the present invention.
Figure 3:
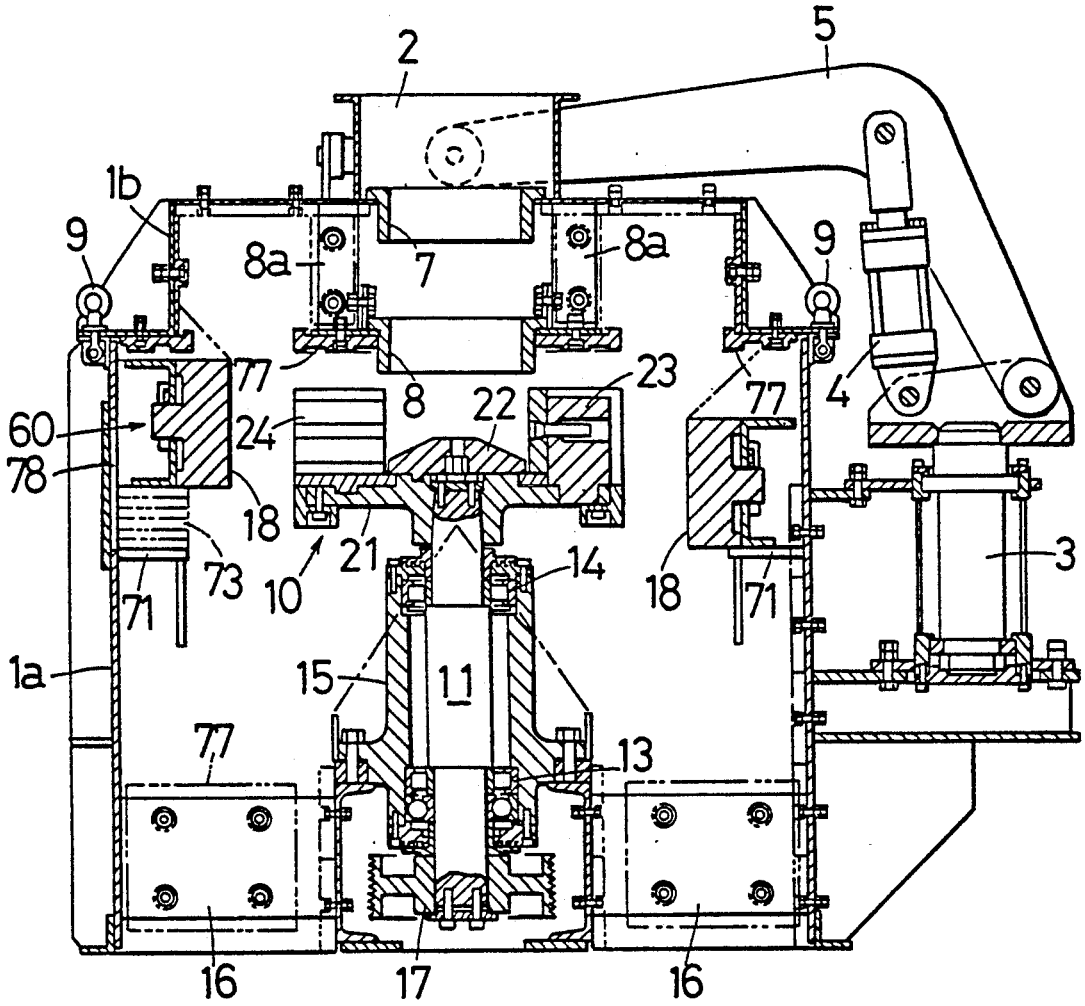
FIG. 3 is a sectional view taken along the line A—A in FIG. 2.
Figure 4:
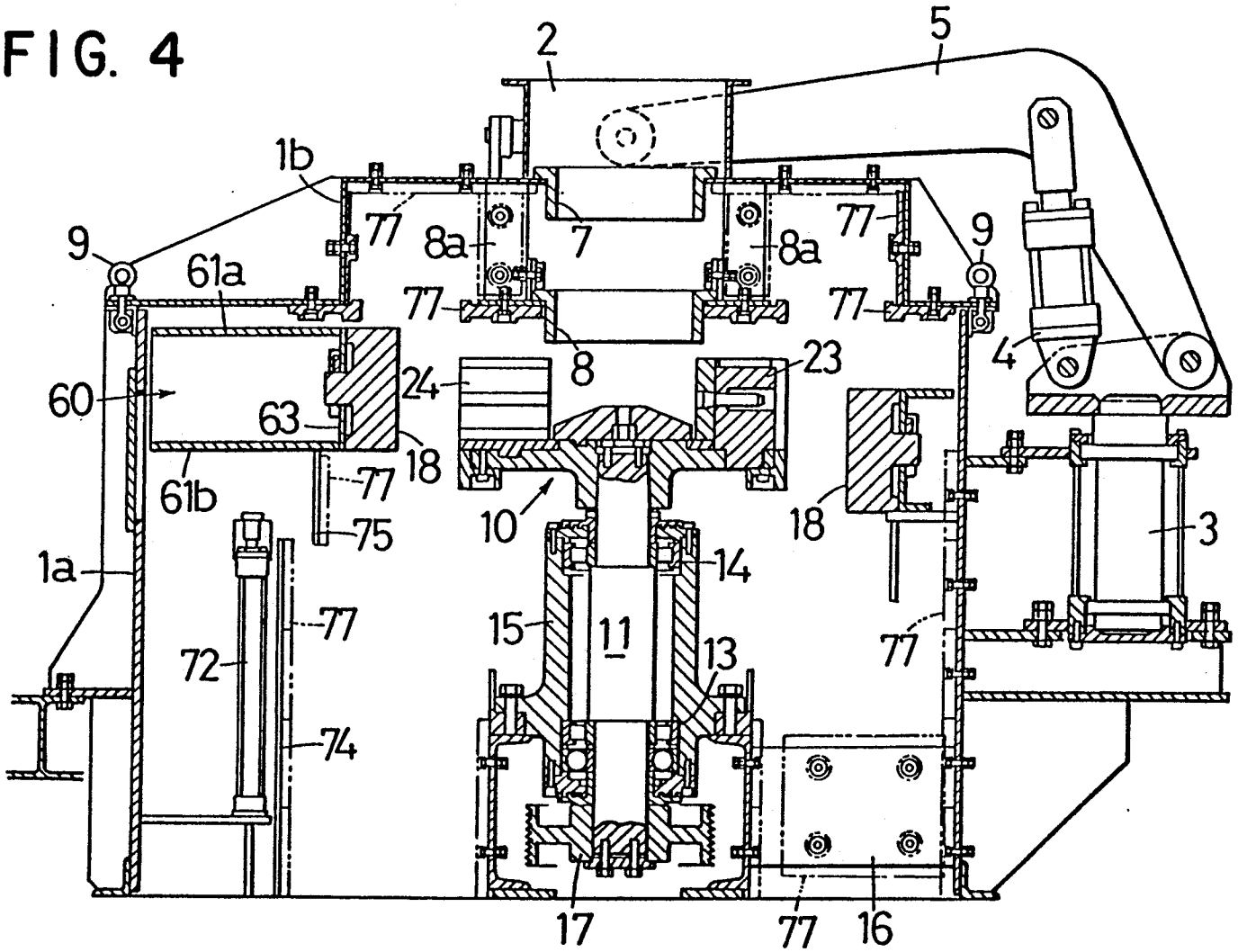
FIG. 4 is a sectional view taken along the line B—B in FIG. 2.

As shown in FIGS. 2 to 4, a large number of anvils 18 are disposed in a ring shape around the rotor 10. Each anvil 18 is attached to a support frame 60.

The support frame 60 has a pair of upper and lower rectangular frame plates 61*a* and 61*b*, each of which has an external size a little smaller than that of the lower housing 1*a* and further has a circular bore 62 in the center. The upper and lower frame plates 61*a* and 61*b* are connected by a large number of circumferentially spaced ribs 61*c*. In addition, an anvil mounting frame 63, to which the anvils 18 are attached, is provided on the inner peripheral surfaces of the upper and lower frame plates 61*a* and 61*b*.

Figure 5:
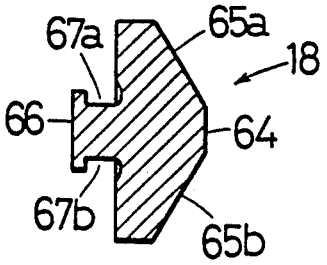
FIG. 5 is a horizontal sectional view of an anvil used in the vertical shaft impact crusher according to the present invention.

As shown in FIG. 5, each anvil 18 has a flat surface 64 on the front, that is, a side thereof which is closer to the rotor 10, and taper surfaces 65*a* and 65*b* are provided at both sides of the flat surface 64. The anvil 18 further has a projection 66 on the back. The projection 66 is provided with a pair of vertical grooves 67*a* and 67*b*. Specifically, the anvil 18 is attached to the mounting frame 63 as follows.

Figure 6:
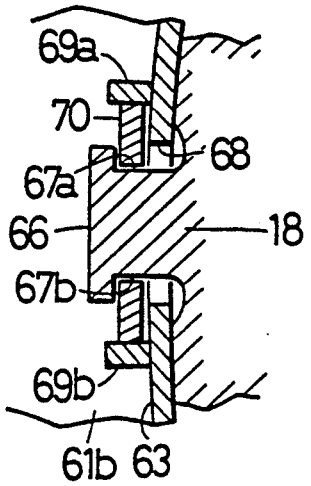
FIG. 6 is a horizontal sectional view showing the way in which the anvil is mounted.
Figure 7:
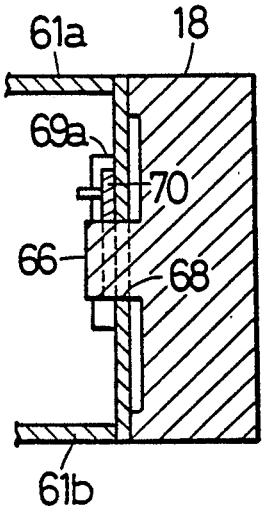
FIG. 7 is a vertical sectional view showing the way in which the anvil is mounted.
Figure 8:
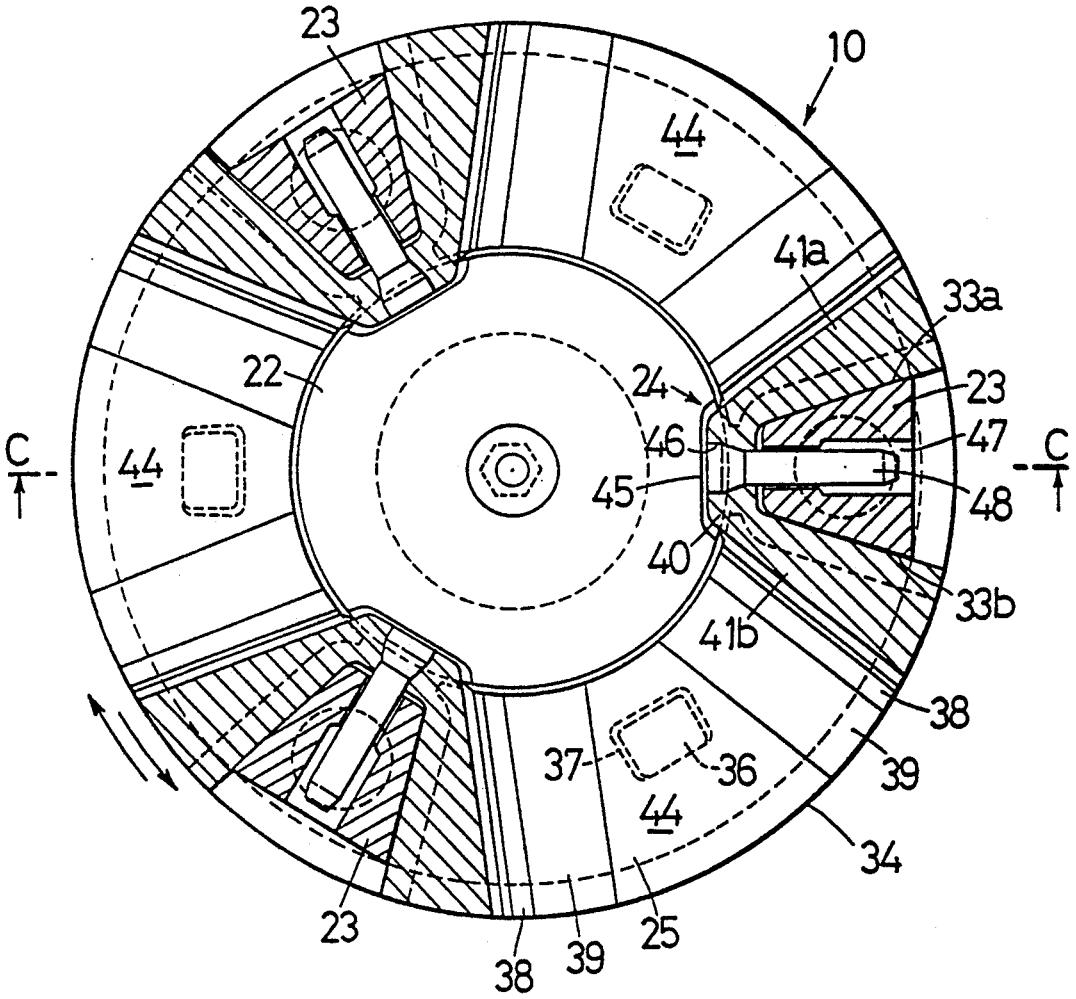
FIG. 8 is a plan view of a rotor used in the vertical shaft impact crusher of the present invention, showing blades and supports in section.
Figure 9:
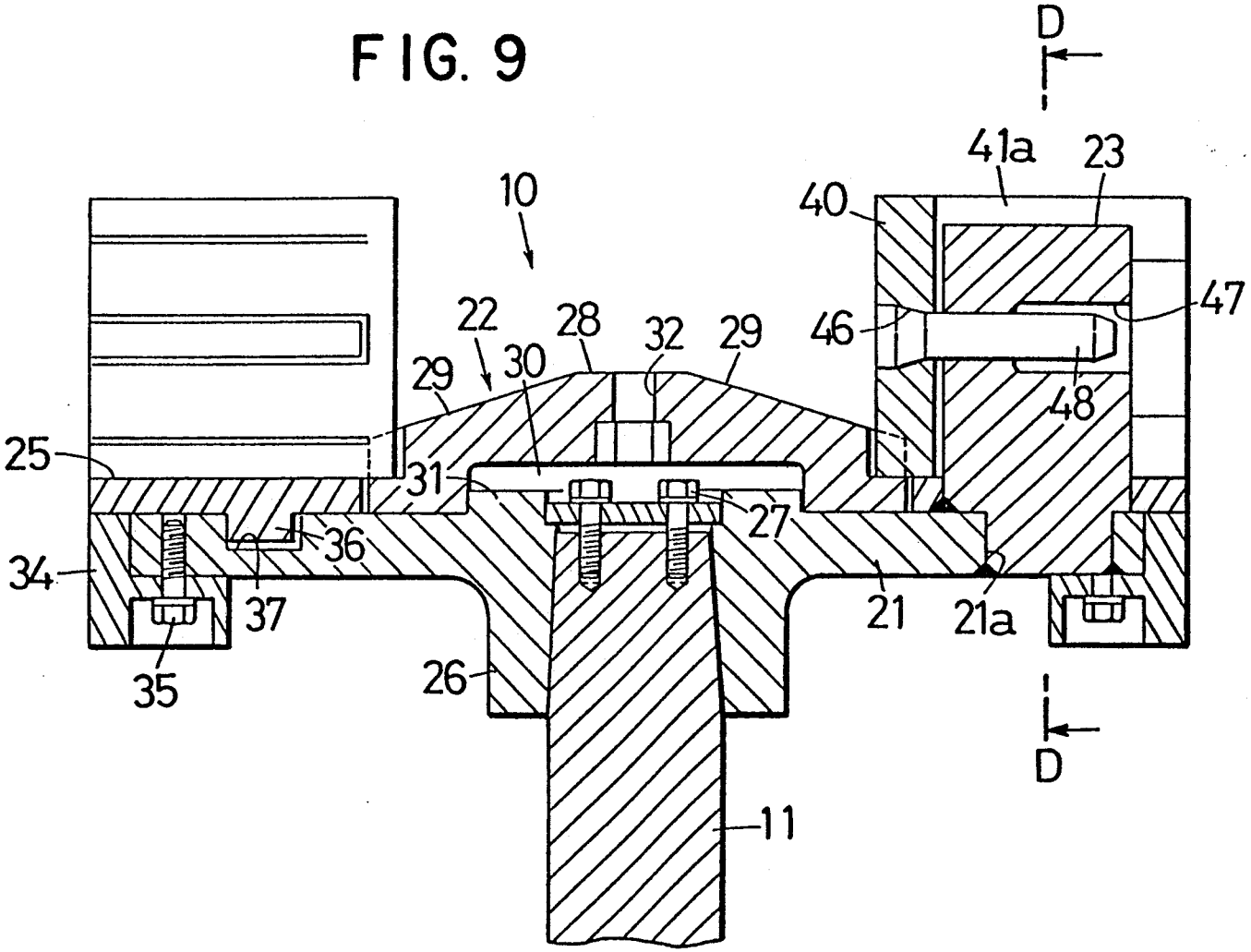
FIG. 9 is a sectional view taken along the line C—C in FIG. 8.
Figure 10:
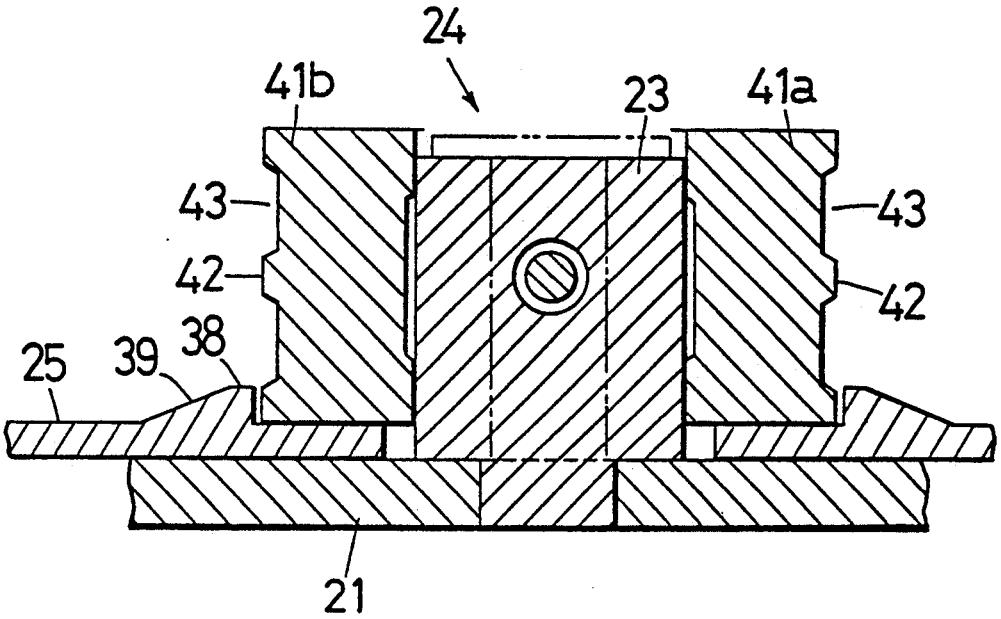
FIG. 10 is a sectional view taken along the line D—D in FIG. 9.

That is, as shown in FIGS. 6 and 7, the projection 66 of the anvil 18 is inserted into a mounting hole 68 that is provided in the mounting frame 63 for each anvil 18. In the meantime, the outer peripheral surface of the mounting frame 63 is provided with a pair of guide plates 69*a* and 69*b*, which are associated with each mounting hole 68. An inverted U-shaped stopper plate 70 is inserted into the vertical grooves 67*a* and 67*b* of the projection 66 along the guide plates 69*a* and 69*b*. In this way, each anvil 18 is secured to the mounting frame 63. This anvil mounting structure per se has already been proposed by the present applicant. The details are explained in Japanese Patent Application Public Disclosure (KOKAI) No. 3-26346 (1991).

Referring to FIGS. 2 to 4, the support frame 60 for the anvils 18 is movable up and down in the lower housing 1*a* in a direction parallel to the central axis of the vertical rotating shaft 11. Support brackets 71 are provided in the four corners, respectively, of the lower housing 1*a*, so that when the support frame 60 moves down to the lowermost position, the lower end thereof is supported by the support brackets 71. The right-hand part of FIG. 3 shows a state where the support frame 60 is in the lowermost position.

Hydraulic cylinders 72 are vertically provided near the respective support brackets 71, so that the support frame 60 is moved up and down by the action of the hydraulic cylinders 72. Spacers 73 are disposed on the support brackets 71 in order to maintain the support frame 60 at a given heightwise position. The left-hand part of FIG. 3 shows a state where spacers 73 are disposed. The spacers 73 have complementary recesses and projections (not shown) formed on the upper and lower surfaces thereof so that the recesses and projections of each pair of adjacent spacers 73 fit to each other to thereby prevent these spacers 73 from coming out of position. The spacers 73 are inserted through inspection windows 78 that are provided in the lower housing 1*a*.

The adjustment of the heightwise position of the support frame 60 is made in such a manner that the support frame 60 is first moved up temporarily by actuating the hydraulic cylinders 72, and a required number of spacers 73 are placed on each support bracket 71, and then the support frame 60 is moved down onto the spacers 73. A protective plate 74 is provided vertically at a side of each hydraulic cylinder 72 which is closer to the center of the lower housing 1*a*. In addition, a protective plate 75 is provided to extend downwardly from the lower side of the support frame 60, so that these protective plates 74 and 75 cooperate with each other to prevent chips of crushed rock from entering the hydraulic cylinder 72.

During the operation of the crusher, small pieces of rock crushed scatter. Therefore, protective liners are provided on the housing inner wall and other parts. In the drawings, reference numeral 77 denotes the protective liners.

Structure of Rotor

FIGS. 8 to 11 show the structure of the rotor 10. The rotor 10 has a rotor body 21, a distributing plate 22, a plurality of supports 23, blades 24, and discharge passage liners 25. The rotor body 21 comprises a disk. The rotor body 21 is fitted onto the vertical rotating shaft 11 through a boss 26 provided on the lower side thereof, and is fastened to the shaft 11 by using bolts 27.

A liner 34 for protection is provided around the outer periphery of the rotor body 21 and secured thereto by using bolts 35. The distributing plate 22 is disposed in the center of the upper side of the rotor body 21. The distributing plate 22 has a flat surface 28 formed in the center of the upper side thereof, and a taper surface 29 is formed around the flat surface 28.

In addition, a circular recess 30 is formed on the lower side of the distributing plate 22. The recess 30 is fitted with a circular step portion 31 that is formed on the upper side of the rotor body 21, thereby effecting positioning of the distributing plate 22. The distributing plate 22 has a bore 32 in the center thereof, so that an engagement piece of a suspending member is engaged with the bore 32 during replacement.

The supports 23 are disposed on the outer periphery of the distributing plate 22. In this embodiment, three supports 23 are provided, and these are disposed at a regular angular spacing of 120 degrees. Each support 23 has a columnar portion at the lower end thereof. The columnar portion is fitted into a bore 21*a* provided in the rotor body 21 and secured to the rotor body 21 by welding. Two outer surfaces 33*a* and 33*b* of each support 23, which extend radially of the rotor body 21, form taper surfaces which diverge radially outward.

Each discharge passage liner 25 is disposed in between a pair of adjacent supports 23. The discharge passage liner 25 has a projection 36 on the lower side, which is fitted into a recess 37 that is provided in the upper side of the rotor body 21, thereby effecting positioning of the discharge passage liner 25. The upper side of the discharge passage liner 25 is formed with two radially extending step portions 38 at both ends thereof in the circumferential direction of the rotor 10. The inner side surfaces 39 of the step portions 38 form taper surfaces.

Each blade 24 has substantially U-shaped configuration. That is, the blade 24 comprises a base 40, which faces the center of the rotor body 21, and a pair of blade plates 41*a* and 41*b*, which extend radially outward from both ends of the base 40. The inner peripheral surfaces of the blade plates 41*a* and 41*b* are shaped so as to be engageable with the taper surfaces 33*a* and 33*b* of the support 23. The outer peripheral surface of each of the blade plates 41*a* and 41*b* is formed with a ridge 42 extending radially of the rotor body 21, and a pair of radial grooves 43 which are provided at the upper and lower sides, respectively, of the ridge 42.

The blade 24 is allowed to slide down onto the support 23 from above it, thereby causing the support 23 to be roughly inserted into the blade 24. Then, the blade 24 is moved radially outward of the rotor body 21 so that the support 23 is fitted in between the two blade plates 41*a* and 41*b*. Thus, the blade 24 is attached to the support 23. As a result, a discharge passage 44 is formed in between each pair of adjacent blades 24.

In addition, as a result of the above-described operation of attaching the blades 24 to the respective supports 23, the circumferential end portions of each discharge passage liner 25, more specifically, the outer portions of the step portions 38, are clamped between the respective blades 24 and the rotor body 21. Further, the base 40 of each blade 24 is received into a notch 45 that is provided in the outer peripheral portion of the distributing plate 22. Thus, the distributing plate 22 is also clamped between the blades 24 and the rotor body 21.

The base 40 of each blade 24 and each support 23 are respectively provided with horizontal bores 46 and 47, which match each other. The horizontal bore 46 is a taper bore. A pin 48 is inserted into these horizontal bores 46 and 47 to thereby retain the blade 24 on the support 23. As the rotor 10 rotates, centrifugal force acts on each blade 24. Accordingly, the blade 24 can be satisfactorily retained on the support 23 with the pin 48 only.

Operation

In the initial stage of use of the crusher, a relatively large number of spacers 73 are placed on each bracket 71 to dispose the anvils 18 at the uppermost position. The rotor 10 is first rotated forwardly at high speed by the operation of the driving motor. Raw stone is cast onto the rotor 10 from the feed opening 2 through the guide chutes 7 and 8. The cast raw stone is distributed to one of the three discharge passages 44 by the distributing plate 22. The raw stone is then accelerated by the blades 24, and discharged toward the anvils 18 by centrifugal force. The raw stone is crushed by collision with the anvils 18 and discharged from the opening in the bottom of the lower casing 1*a*.

The anvils 18 wear during such a crushing process. Since the anvils 18 are disposed at the uppermost position in the initial stage of use of the crusher, wear takes place in the lower portions of the anvils 18. When the wear reaches a predetermined level, the hydraulic cylinders 72 are activated to move up the support frame 60 temporarily, and an appropriate number of spacers 73 are removed from each stack of spacers 73. Then, the support frame 60 is lowered onto the remaining spacers 73, thereby being supported by them. Thus, as the wear progresses, an appropriate number of spacers 73 are removed for each adjusting operation so as to lower the support frame 60 successively, thereby subjecting each anvil 18 to wear over the entire area thereof in the heightwise direction.

Wear also takes place on the distributing plate 22, the discharge passage liners 25 and the blades 24 during the crushing process. In particular, the blades 24 wear at the lower-half portions of the blade plates 41*a* and 41*b*. During the forward rotation of the rotor 10, wear mainly takes place on one blade plate 41*a*. Accordingly, when the wear on the first blade plate 41*a* reaches a predetermined level, the direction of rotation of the rotor 10 is reversed to subject the other blade plate 41*b* to wear.

When the wear on the second blade plate 41*b* reaches a predetermined level, the pins 48 are pulled out, and the blades 24 are removed from the supports 23 and turned upside down and then remounted on the respective supports 23. Thereafter, the rotor 10 is rotated forwardly and then backwardly, thereby subjecting the remaining half-portions of the two blade plates 41*a* and 41*b* to wear one after another in the mentioned order. In this way, each blade 24 can be subjected to wear over substantially the entire area thereof. This operation is also extremely easy because the blades 24 can be removed simply by pulling out the pins 48. Replacement of the blades 24 themselves can also be readily effected in the same way as the above.

The two taper surfaces 39 of each discharge passage liner 25 are also subjected to wear one after another by reversing the direction of rotation of the rotor 10. The discharge passage liners 25 can be readily replaced simply by pulling out the pins 48 and removing the blades 24. In regard to the distributing plate 22, since it is clamped between the blades 24 and the rotor body 21 in the same way as the discharge passage liners 25, the distributing plate 22 can also be readily replaced simply by removing the blades 24.

Although in the above-described embodiment the anvils 18 are each subjected to wear over the entire area thereof with the support frame 60 lowered successively from the raised position, the support frame 60 may be moved upwardly from the lowered position.

Second Embodiment of Housing

Figure 12:
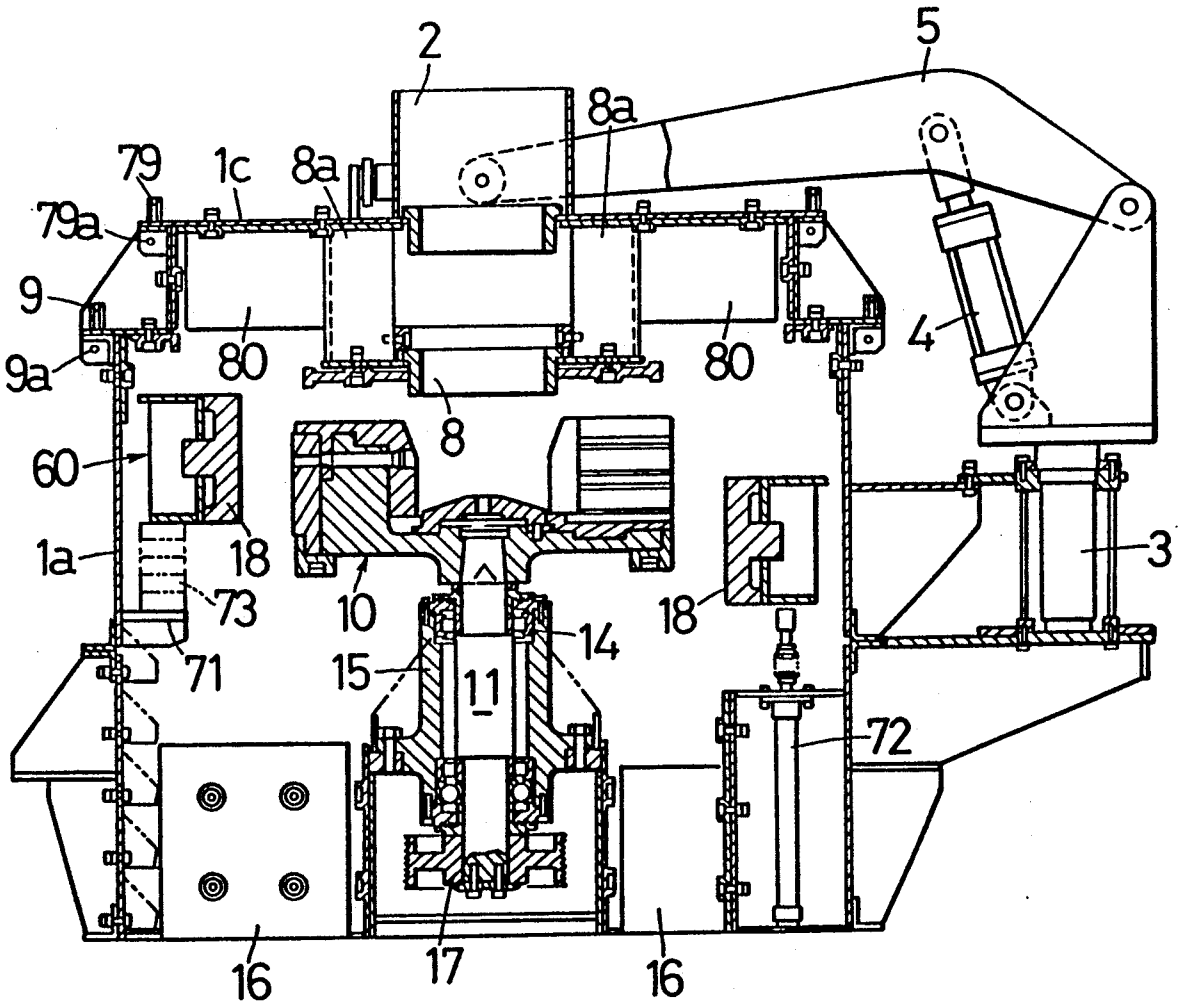
FIG. 12 is a sectional view showing another embodiment of a housing used in the vertical shaft impact crusher of the present invention.

FIG. 12 shows a second embodiment of the housing. In the above-described embodiment, the upper housing 1*b* is opened and closed with respect to the lower housing 1*a* by the action of the lever 5. In this embodiment, not only the upper housing 1*b* but also a cover 1*c* is opened and closed by the action of the lever 5. The cover 1*c* is detachably secured to the upper housing 1*b* through fastening members 79 that are pivotable about respective shafts 79*a*.

A large number of guide plates 80, which extend radially of the rotor 10, are attached to the lower side of the cover 1*c*. The guide plates 80 are circumferentially spaced in an annular shape as a whole. When raw stone is being crushed, a pressurized air flow is induced by the high-speed rotation of the rotor 10. The air flow is a circulating flow that ascends from the periphery of the rotor 10 and descends through the ribs 8*a* and the guide chutes 8.

The air flow is likely to become a turbulent flow when it shifts from the ascending flow to the descending flow. Turbulence of the air flow invites a loss of crushing energy and hence produces an adverse effect on the crushing process. In this embodiment, the guide plates 80 prevent the air flow from becoming turbulent and hence enable crushing of high energy efficiency. Although crushing chips are attached to the guide plates 80, since the cover 1*c* per se can be opened and closed as desired, the guide plates 80 can be cleaned with ease by raising the cover 1*c* to open.

Second Embodiment of Rotor

Figure 13:
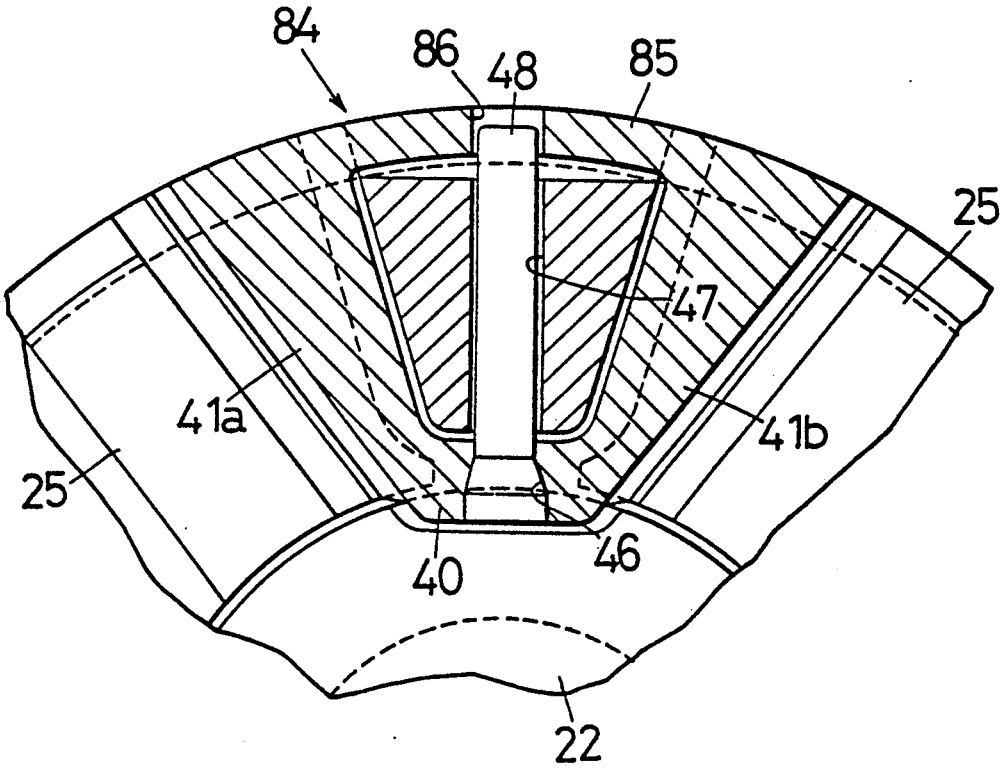
FIG. 13 is a partly-sectioned plan view of another embodiment of the rotor, showing a blade and a support in section.
Figure 11:
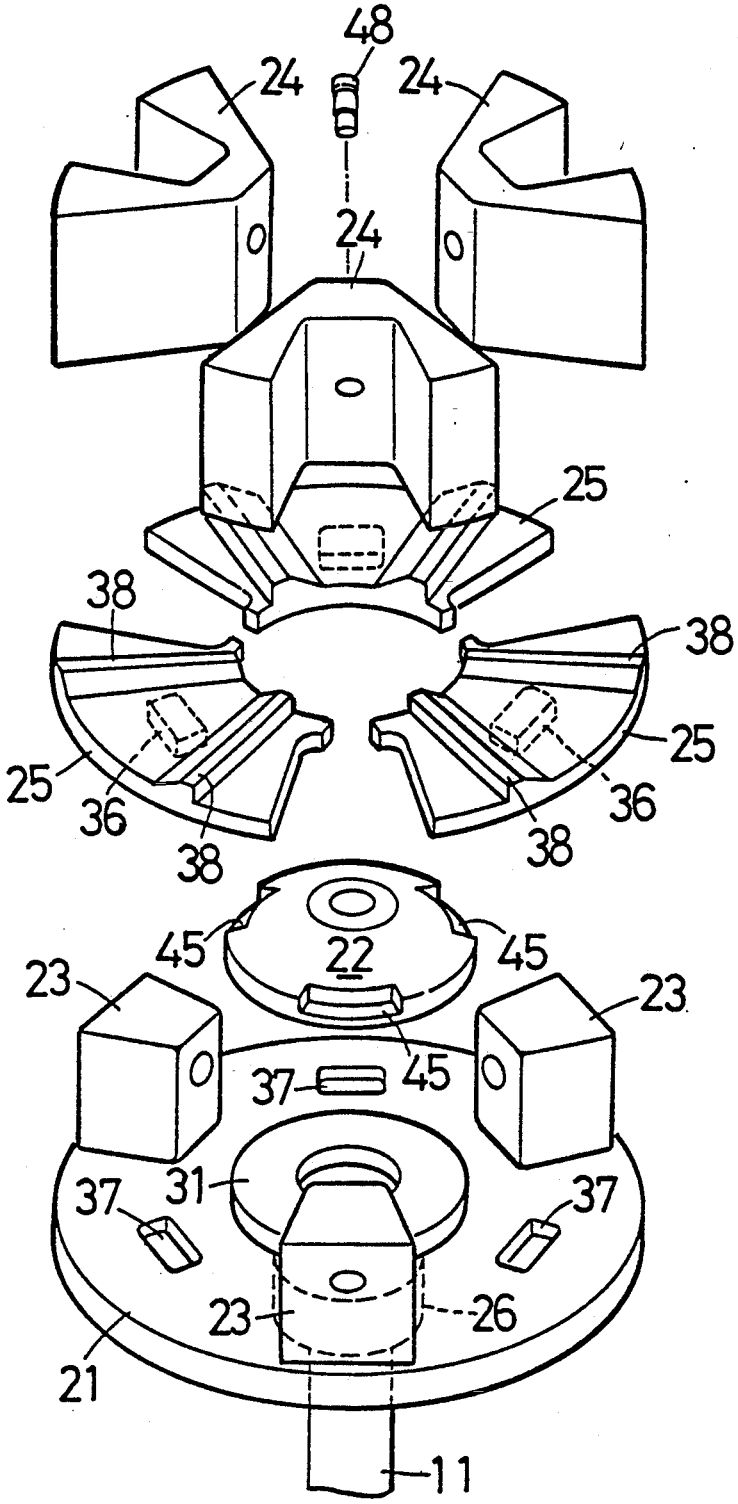
FIG. 11 is an exploded perspective view of elements of the rotor.

FIG. 13 shows a second embodiment of the rotor 10. In the above-described embodiment, there is an opening in between the respective ends of the blade plates 41*a* and 41*b* of each blade 24. In contrast, in this embodiment the respective ends of the blade plates 41*a* and 41*b* are connected by a curved portion 85. Consequently, the blade 84 has a tubular shape as a whole.

The curved portion 85 is also provided with a horizontal bore 86 which matches both the horizontal bores 46 and 47. The pin 48 is inserted into the horizontal bore 86 through the horizontal bores 46 and 47. In production, blades are usually subjected to a heat treatment after a casting process. By closing the opening between the respective ends of the blade plates 41a and 41b as in the blade 84, the blade plates 41a and 41b can be prevented from being distorted during the manufacturing process.

Third Embodiment of Rotor

Figure 14:
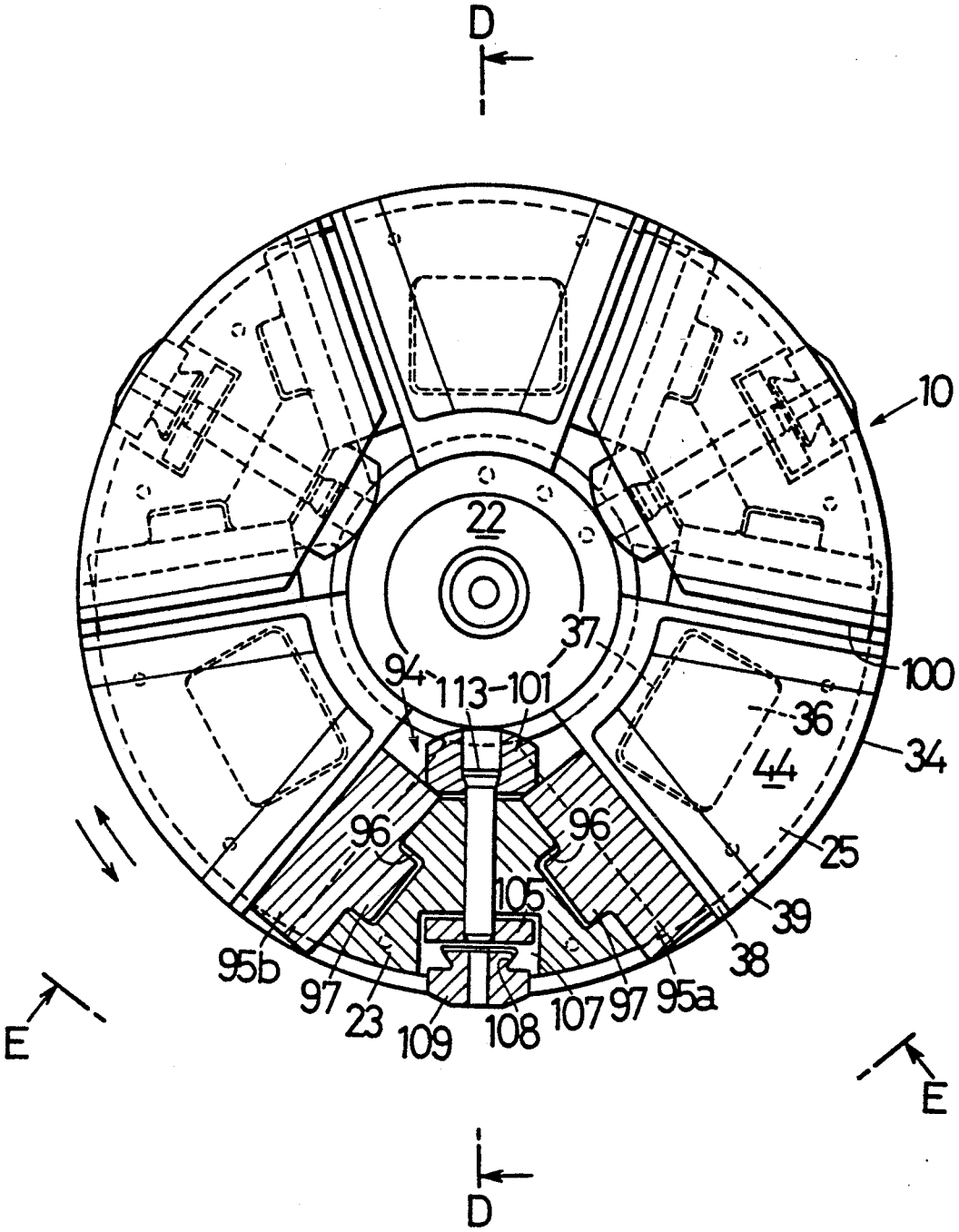
FIG. 14 is a plan view showing still another embodiment of the rotor, showing blades and supports in section.
Figure 15:
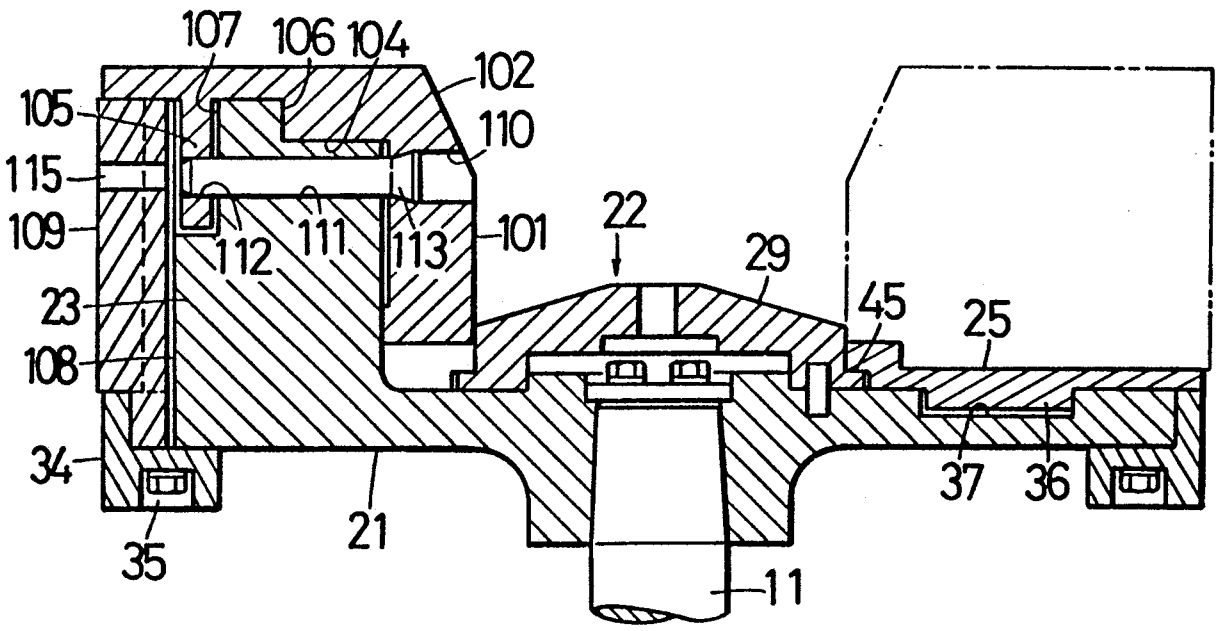
FIG. 15 is a sectional view taken along the line D—D in FIG. 14.
Figure 16:
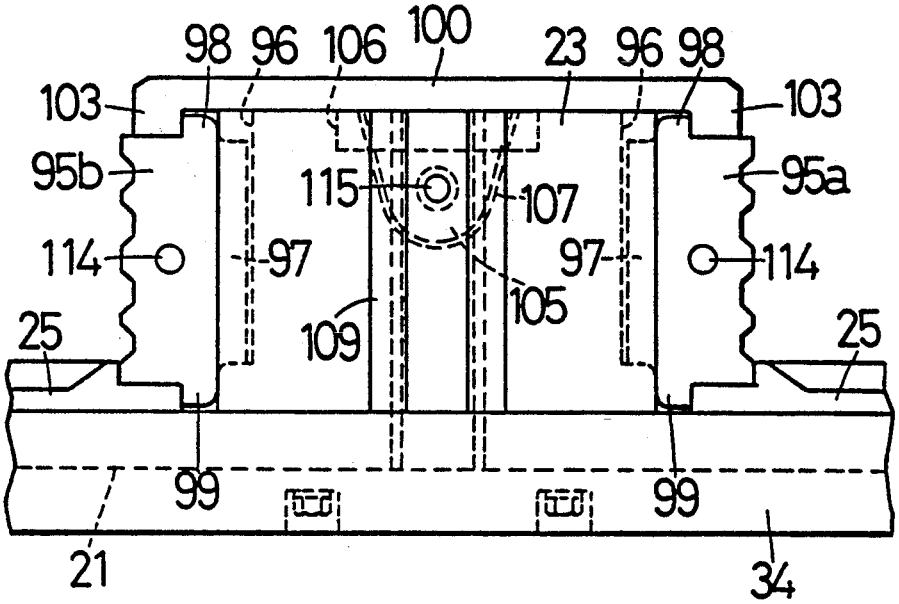
FIG. 16 is a view seen from the arrow E—E in FIG. 14.

FIGS. 14 to 16 show a third embodiment of the rotor 10. In this embodiment, the supports 23 are formed as integral parts of the rotor body 21. In addition, the notches 45, which are provided in the distributing plate 22, are engaged with the respective inner peripheral end portions of the discharge passage liners 25. Further, each blade 94 comprises a pair of blade plates 95a and 95b, which are independent of each other. Each support 23 has vertically extending grooves 96 formed in both side surfaces thereof, which extend radially of the rotor body 21. The grooves 96 extend as far as the top of the support 23. The grooves 96 may be formed horizontally. However, the vertical grooves 96 allow the blade plates 95a and 95b to slide down therethrough from above the support 23 when the blade plates 95a and 95b are mounted on the support 23, as described later.

On the other hand, the side surfaces of the blade plates 95a and 95b, which face the support 23, are formed with vertically extending projections 97, respectively. The projections 97 are fittable into the vertical grooves 96. Further, the upper and lower sides of each of the blade plates 95a and 95b are formed with ridges 98 and 99, respectively, which extend radially of the rotor body 21. The blade plates 95a and 95b are retained on the support 23 by a top plate 100 that is placed over the support 23.

The top plate 100 has a downwardly extending portion 101 at the inward end thereof as viewed in the radial direction of the rotor boy 21. The downwardly extending portion 101 has a taper surface 102 on the upper portion of the outer side thereof. The downwardly extending portion 101 is engageable with the inward end face of the support 23 as viewed in the radial direction of the rotor body 21. The top plate 100 further has downwardly extending portions 103 provided on the respective lower sides of both end portions extending radially of the rotor body 21. The downwardly extending portions 103 are engageable with the ridges 98 of the blade plates 95a and 95b.

The lower side of the central portion of the top plate 100 is provided with a step portion 104 and a downwardly extending plate 105. The step portion 104 is engageable with a step portion 106 that is provided on the upper side of the support 23. The downwardly extending plate 105 is receivable into a recess 107 that is provided in the upper side of the support 23. The outward end portion of the support 23, as viewed in the radial direction of the rotor body 21, is formed with a vertically extending dovetail groove 108, which is contiguous with the recess 107. The dovetail groove 108 is engageable with an end liner 109.

The blade plates 95a and 95b are allowed to slide down onto the support 23 from above it so that the projections 97 fit into the respective vertical grooves 96. The blade plates 95a and 95b are provided with bores 114 for engagement with a suspending member (not shown), which is used to mount the blade plates 95a and 95b onto the support 23. In a state where the blade plates 95a and 95b are disposed on both side surfaces of the support 23, the lower ridges 99 of the blade plates 95a and 95b engage with the circumferential end portions of the discharge passage liners 25. Thus, the discharge passage liners 25 are clamped between the blade plates 95a and 95b and the rotor body 21.

After the end liner 109 has been inserted into the dovetail groove 108, the support 23 is covered with the top plate 100. In this state, the step portion 104 of the top plate 100 engages with the step portion 106 of the support 23, and the downwardly extending plate 105 is received into the recess 107. In addition, the downwardly extending portions 103 of the top plate 100 engage with the upper ridges 98 of the blade plates 95a and 95b. Thus, the blade plates 95a and 95b are retained on the support 23.

The downwardly extending portion 101 of the top plate 100, the support 23 and the downwardly extending plate 105 of the top plate 100 are provided with respective bores 110, 111 and 112, which match each other. A pin 113 is inserted into the bores 110, 111 and 112, thereby retaining the top plate 100 on the support 23. According to this embodiment, the blade plates 95a and 95b are each subjected to wear over the entire area thereof even more extensively than in the case of the blades in the above-described two embodiments.

Figure 17:
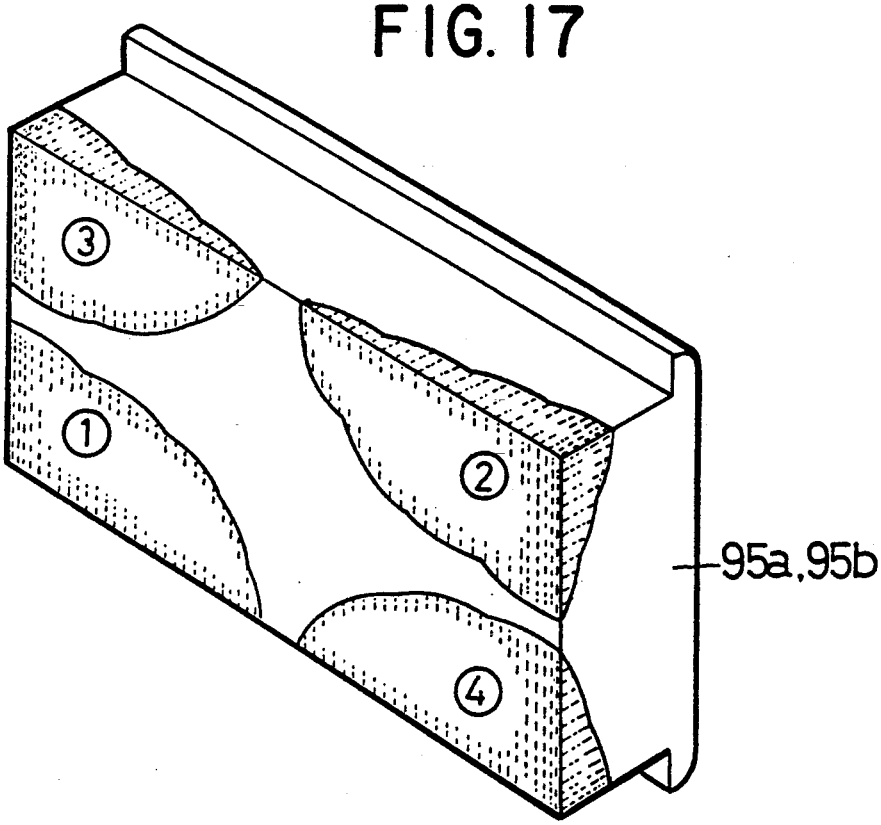
FIG. 17 is a view for explanation of the sequence in which a blade plate becomes worn.

Assuming that wear mainly takes place on the blade plate 95a during the crushing process carried out by forward rotation of the rotor 10, the worn portion is a lower portion of the radially outward part of the blade plate 95a. The portion concerned is a region that is denoted by ① in FIG. 17. When the region ① has become worn, the blade plate 95a is removed and turned upside down and then remounted onto the support 23. Consequently, wear then takes place mainly on the region ②.

When the region ② has become worn, the blade plates 95a and 95b are replaced with each other. Consequently, wear first takes place on the region ③ of the blade plate 95a during the crushing process carried out by the backward rotation of the rotor 10. Then, wear takes place on the region ④ after the blade plate 95a has been turned upside down. The same is the case with the blade plate 95b, although the way in which the blade plate 95b wears differs from that of the blade plate 95a in terms of the direction of rotation of the rotor 10.

Raw stone that is discharged from one discharge passage 44 may collide with the rotor 10 after rebounding from the anvils 18. What is designed to collide with the rebounding raw stone is the end liner 109, which is detachably attached to the support 23. The end liner 109 is provided with a bore 115, which is engaged with a suspending member (not shown) when the end liner 109 is attached and detached. The end liner 109 is provided in the middle between two discharge passages 44, which is a position where the probability of collision occurring is high. The end face of the end liner 109 projects a little outward from the outer peripheral surface of the liner 34.

It should be noted that the foregoing embodiments are merely illustrative examples of the present invention and that various changes and modifications may be imparted thereto. For example, although in the described embodiments the hydraulic cylinders 72 are used as means for vertically moving the support frame 60, the present invention is not necessarily limited thereto. For example, a combination of a rack and a pinion may also be used. In addition, the heightwise position adjusting means may be a combination of a positioning bolt, which is provided on each support bracket 71 so as to be movable in the axial direction of the vertical rotating shaft 11, and a stopper. It is also possible to employ a multistage cylinder, or a known mechanical positioning means.

In addition, although in the foregoing embodiments the number of blades is three, it should be noted that the number of blades is not limitative. The configuration of the blades is not limited to those in the embodiments, either.

Further, the rotor structure according to the present invention may be applied not only to a vertical shaft impact crusher having anvils as impact surfaces but also to other vertical crushers wherein a dead stock is formed from crushed rock at the outer periphery of a rotor, and this dead stock is used as an impact surface.

According to the present invention, each anvil is subjected to wear over the entire area thereof in the heightwise direction. Therefore, it is possible to reduce the frequency of replacement of anvils and hence lower the running cost. Adjustment of the heightwise position of the anvils can also be made extremely easily. In addition, the present invention allows each blade to be subjected to wear over the entire area thereof. Therefore, it is possible to reduce the frequency of replacement of blades and hence lower the running cost. Replacement of blades can also be effected extremely easily.

What is claimed is:

1. A vertical shaft impact crusher having a housing, a vertical rotating shaft (11) rotatably provided in said housing and rotated at a high speed, a rotor (10) provided on an upper end of said vertical rotating shaft (11) to discharge centrifugally an object of crushing, which is cast into said housing, to an outer periphery thereof, and an anvil support frame (60) disposed in said housing to surround the outer periphery of said rotor (10) and provided with anvils (18) for collision with the object of crushing discharged from said rotor (10), wherein the improvement comprises said anvil support frame (60) which is movable up and down in a direction parallel to a central axis of said vertical rotating shaft (11), support means (71) disposed in said housing for supporting a lower end of said anvil support frame (60), vertically moving means (72) disposed in said housing for vertically moving said anvil support frame (60) in the direction of said central axis, and adjusting means (73) disposed on said support means (71) for adjusting the heightwise position of said anvils (18) when said anvil support frame (60) is moved up by said vertically moving means (72).

2. A vertical shaft impact crusher according to claim 1, wherein said adjusting means comprises a multiplicity of spacers (73).

3. A vertical shaft impact crusher according to claim 1 or 2, further comprising, a cover (1c) provided on the top of said hosing so as to be capable of being opened and closed and having a feed opening (2) for the object of crushing, and a multiplicity of guide plates (80) provided on a lower side of said cover (1c) to extend radially from said central axis so as to guide an ascending air flow induced by rotation of said rotor (10).

4. A vertical shaft impact crusher having a housing, a vertical rotating shaft (11) rotatably provided in said housing and rotated at a high speed, and a rotor (10) provided on an upper end of said vertical rotating shaft (11) to discharge centrifugally an object of crushing, which is cast into said housing, toward an impact surface (18) disposed at an outer periphery thereof, wherein the improvement comprises means for driving said vertical rotating shaft (11) to rotate forwardly and backwardly, a rotor body (21) secured to said vertical rotating shaft (11), a substantially disk-shaped distributing plate (22) disposed in a center of an upper side of said rotor body (21), a plurality of supports (23) provided on the upper side of said rotor body (21) at a regular angular spacing around an outer periphery of said distributing plate (22), blades (24) disposed on said supports (23), respectively, so as to cover at least two side surfaces of each support (23), means (48) or (98) for detachably retaining said blades (24) on said supports (23), a discharge passage (44) formed in between each pair of adjacent blades (24), and a discharge passage liner (25) disposed on said discharge passage (44);

wherein said blades (24) each comprise a base (40) which covers an inward end face of said support (23) as viewed in the radial direction of said rotor body (21), and a pair of blade plates (41a) and (41b) which extend outwardly in said radial direction from both ends of said base (40) to cover said two side surfaces of said support (23).

5. A vertical shaft impact crusher according to claim 4, wherein said blades each comprise a curved portion which connects respectively distal ends of said blade plates and covers an outward end face of said support as viewed in said radial direction.

6. A vertical shaft impact crusher according to claim 6, wherein said retaining means for said blades (24) or (84) comprises horizontal bores (46) and (47), which are respectively provided in said base (40) of said blade (24) and said support (23) so as to match each other, and a pin (48) inserted into said horizontal bores (46) and (47).

7. A vertical shaft impact crusher according to claim 4, wherein said blade plates cover said two side surfaces of said support independently of each other.

8. A vertical shaft impact crusher according to claim 7, wherein said retaining means for said blades (94) comprises grooves (96) formed in said two side surfaces of said support (23), projections (97) formed on respective surfaces of said blade plates (95a) and (95b), which face said support (23), so as to be engageable with said grooves (96), ridges (98) formed on respective upper sides of said blade plates (95a) and (95b) to extend in said radial direction, a top plate (100) disposed to cover an upper side of said support (23), and downwardly extending portions (103) formed on respective lower sides of two end portions of said top plate (100), which extend in said radial direction, so as to be engageable with said ridges (98) of said blade plates (95*a*) and (95*b*).

9. A vertical shaft impact crusher according to claim 7, further comprising an end liner (108) provided on an outward end portion of said support (23) as viewed in said radial direction so that an end face of said end liner (108) projects from the outer peripheral edge of said rotor body (21).

10. A vertical shaft impact crusher according to claim 4, wherein said blades (24) clamp two circumferential end portions of said discharge passage liner (25), which extend in said radial direction, between the same and said rotor body (21).

11. A vertical shaft impact crusher according to claim 4, wherein said blades (24) clamp an outer peripheral portion of said distributing plate (22) between the same and said rotor body (21).

12. A vertical shaft impact crusher according to claim 4, wherein a lower side of said discharge passage liner (25) and the upper side of said rotor body (21) are formed with a projection(36) and a groove (37), respectively, which are engageable with each other.

13. A vertical shaft impact crusher having a housing, a vertical rotating shaft rotatably provided in said housing and rotated at a high speed, and a rotor provided on an upper end of said vertical rotating shaft to discharge centrifugally an object of crushing, which is cast into said housing, toward an impact surface disposed at an outer periphery thereof, wherein the improvement comprises means for driving said vertical rotating shaft to rotate forwardly and backwardly, a rotor body secured to said vertical rotating shaft, a substantially disk-shaped distributing plate disposed in a center of an upper side of said rotor body, a plurality of supports provided on the upper side of said rotor body at a regular angular spacing around an outer periphery of said distributing plate, blades disposed on said supports, respectively, so as to cover at least two side surfaces of each support, which extend substantially radially of said rotor body, means for detachably retaining said blades on said supports, a discharge passage formed in between each pair of adjacent blades, and a discharge passage liner disposed on said discharge passage;

wherein said blades each comprise a base which covers an inward end face of said support as viewed in the radial direction of said rotor body, a pair of blade plates and which extend outwardly in said radial direction from both ends of said base to cover said two side surfaces of said support, and a curved portion which connects respectively distal ends of said blade plates and covers an outward end face of said support as viewed in said radial direction.

14. A vertical shaft impact crusher according to claim 13, wherein said blade plates which cover said two side surfaces of said support, cover said side surfaces independently of each other.

15. A vertical shaft impact crusher according to claim 14, wherein said retaining means for said blades comprises grooves formed in said two side surfaces of said support, projections formed on respective surfaces of said blade plates, which face said support, so as to be engageable with said grooves, ridges formed on respective upper sides of said blade plates to extend in said radial direction, a top plate disposed to cover an upper side of said support, and downwardly extending portions formed on respective lower sides of two end portions of said top plate, which extend in said radial direction, so as to be engageable with said ridges of said blade plates.

16. A vertical shaft impact crusher according to claim 14, wherein comprising an end liner provided on an outward end portion of said support as viewed in said radial direction so that an end face of said end liner projects from the outer peripheral edge of said rotor body.

17. A vertical shaft impact crusher according to claim 14, wherein said blades clamp two circumferential end portions of said discharge passage liner, which extend in said radial direction, between the same and said rotor body.

18. A vertical shaft impact crusher according to claim 13, wherein said blades clamp an outer peripheral portion of said distributing plate between the same and said rotor body.

19. A vertical shaft impact crusher according to claim 13, wherein a lower side of said discharge passage liner and the upper side of said rotor body are formed with a projection and a groove, respectively, which are engageable with other.

20. A vertical shaft impact crusher according to claim 13, wherein said retaining means for said blades comprises horizontal bores which are respectively provided in said base of said blade and said support so as to match each other, and a pin inserted into said horizontal bores.

21. A vertical shaft impact crusher having a housing, a vertical rotating shaft rotatably provided in said housing and rotated at a high speed, and a rotor provided on an upper end of said vertical rotating shaft to discharge centrifugally an object of crushing, which is cast into said housing, toward an impact surface disposed at an outer periphery thereof, wherein the improvement comprises means for driving said vertical rotating shaft to rotate forwardly and backwardly, a rotor body secured to said vertical rotating shaft, a substantially disk-shaped distributing plate disposed in a center of an upper side of said rotor body, a plurality of supports provided on the upper side of said rotor body at a regular angular spacing around an outer periphery of said distributing plate, blades disposed on said supports, respectively, so as to cover at least two side surfaces of each support, which extend substantially radially of said rotor body, means for detachably retaining said blades on said supports, a discharge passage formed in between each pair of adjacent blades, and a discharge passage liner disposed on said discharge passage;

wherein said blades each comprise a pair of blade plates which cover said two side surfaces of said support independently of each other; and wherein said retaining means for said blades comprises grooves formed in said two side surfaces of said support, projections formed on respective surfaces of said blade plates, which face said support, so as to be engageable with said grooves, ridges formed on respective upper sides of said blade plates to extend in said radial direction, a top plate disposed to cover an upper side of said support, and downwardly extending portions formed on respective lower sides of two end portions of said top plate, which extend in said radial direction, so as to be engageable with said ridges of said blade plates.

22. A vertical shaft impact crusher according to claim 21, wherein said blades each comprise a base which covers an inward end face of said support as viewed in the radial direction of said rotor body.

23. A vertical shaft impact crusher according to claim 22, wherein said retaining means for said blades comprises horizontal bores, which are respectively provided in said base of said blade and said support so as to match each other, and a pin inserted into said horizontal bores.

24. A vertical shaft impact crusher according to claim 21, wherein said blades clamp two circumferential end portions of said discharge passage liner, which extend in said radial direction, between the same and said rotor body.

25. A vertical shaft impact crusher according to claim 21, wherein said blades clamp an outer peripheral portion of said distributing plate between the same and said rotor body.

26. A vertical shaft impact crusher according to claim 21, wherein a lower side of said discharge passage liner and the upper side of said rotor body are formed with a projection and a groove, respectively, which are engageable with other.

27. A vertical shaft impact crusher according to claim 21, further comprising an end liner provided on an outward end portion of said support as viewed in said radial direction so that an end face of said end liner projects from the outer peripheral edge of said rotor body.

* * * * *